United States Patent [19]

Gardner

[11] Patent Number: 4,482,054

[45] Date of Patent: Nov. 13, 1984

[54] SUPPORT AND CUSHIONING TUBE

[75] Inventor: Roland C. Gardner, Doylestown, Pa.

[73] Assignee: Clevepost, Inc., Cincinnati, Ohio

[21] Appl. No.: 370,793

[22] Filed: Apr. 22, 1982

[51] Int. Cl.[3] ..... B65D 81/02

[52] U.S. Cl. ..... 206/594; 206/453; 206/586; 206/591; 206/593; 206/597; 206/320

[58] Field of Search ..... 206/453, 521, 522, 586, 206/591, 592, 593, 594, 597, 587, 599, 600, 320; 229/49, DIG. 1, DIG. 5

[56] References Cited

U.S. PATENT DOCUMENTS

| | | | |
|---|---|---|---|
| 1,034,567 | 8/1912 | Beadle . | |
| 1,595,856 | 6/1925 | Clark | 229/DIG. 5 |
| 1,725,592 | 8/1929 | Mertes . | |
| 1,821,692 | 9/1931 | Copeland . | |
| 1,963,056 | 6/1934 | Wilcox . | |
| 2,874,826 | 2/1959 | Matthews et al. | 206/522 |
| 2,922,344 | 1/1960 | Meissner | 206/522 |
| 3,231,454 | 1/1966 | Williams | 206/594 |
| 3,244,347 | 4/1966 | Jenk . | |
| 3,335,932 | 8/1967 | Brown | 206/453 |
| 3,648,920 | 3/1972 | Stump | 229/49 |
| 3,665,818 | 5/1972 | Stump et al. . | |
| 3,665,819 | 5/1972 | Gardner . | |
| 3,708,101 | 1/1973 | McDanield | 229/DIG. 1 |
| 3,736,846 | 6/1973 | Frankenberg . | |
| 3,935,357 | 1/1975 | Padovani | 206/594 |
| 3,957,196 | 5/1976 | Kellerman | 206/586 |
| 4,044,867 | 8/1977 | Fisher | 206/522 |
| 4,069,638 | 1/1978 | Hazzelqvist et al. . | |
| 4,244,471 | 1/1981 | Plante . | |
| 4,292,901 | 10/1981 | Cox | 206/453 |
| 4,317,517 | 3/1982 | Tisdale | 206/597 |

FOREIGN PATENT DOCUMENTS

| | | | |
|---|---|---|---|
| 2448483 | 5/1980 | France | 206/586 |
| 2080767 | 2/1982 | United Kingdom | 206/586 |

*Primary Examiner*—Joseph Man-Fu Moy
*Assistant Examiner*—David Fidei
*Attorney, Agent, or Firm*—Wood, Herron & Evans

[57] ABSTRACT

An elongated tube of convoluted fiber-containing sheet material, in which the fibers extend predominantly longitudinally and the convolutions are bonded together with a hardenable bonding material, which is flattened to provide at least a pair of opposed spaced parallel walls having longitudinally-extending grooves, beads, or indentations to provide enhanced support in terms of improved resistance to longitudinally-directed compressive loads, and enhanced cushioning in terms of improved resistance to transversely directed forces.

6 Claims, 3 Drawing Figures

SUPPORT AND CUSHIONING TUBE

This invention relates to support and/or cushioning tubes of the type fabricated of convoluted fiber-containing sheet material in which the fibers extend predominantly longitudinally and the convolutions are bonded together with a hardenable bonding material, and more particularly, to an improved support and/or cushioning tube which by reasons of its shape and configuration provides enhanced resistance to axially directed compressive loads as well as enhanced cushioning against transversely directed forces.

In many situations in which corrugated or solid fiber containers are used, it is necessary to reinforce the container to protect the contents against damage from external forces as well as permit the containers to be vertically stacked directly upon each other without damaging the contents of the lower containers due to the weight of the contents of the upper containers. In accordance with one container reinforcement scheme, disclosed in U.S. Pat. No. 3,648,920, assigned to the assignee of the present application, cubicle rigidity of the container, both with respect to axial and transverse forces, is provided by vertically disposing elongated tubes of generally triangular cross-section at the internal vertical corners of the container and, where necessary, vertically disposing such tubes along the interior walls of the container intermediate the corners. In accordance with the teachings of the above-mentioned patent, the reinforcing tube is fabricated of convoluted fiber-containing sheet material in which the fibers extend predominantly longitudinally of the tube and in which the convolutions are bonded together with a hardenable bonding material.

While the generally triangular cross-section reinforcing tube of the above-mentioned patent has found widespread utility in a variety of applications, it has not been found to be entirely satisfactory in reinforcing applications where compressive support in an axial direction and cushioning support in a transverse direction are desired over a relatively large area per unit length of the elongated tubular support. Stated differently, the generally triangular shaped reinforcing tubes of the type disclosed in the above-mentioned patent extend in a direction transverse to the longitudinal axis thereof only a limited amount relative to the overall length of the tubular support. By reason of this characteristic of the tubular supports of the above-mentioned patent, use of such tubes has not been extended to applications requiring axial compressive support and lateral cushioning support over a relatively large area per unit length of tube.

Accordingly, it has been an objective of this invention to provide a reinforcing tube having enhanced resistance to longitudinal compressive forces and improved cushioning against transversely directed forces over a greater area per unit length of tube than heretofore possible with reinforcing tubes of known construction, such as disclosed in U.S. Pat. No. 3,648,920. This objective has been accomplished in accordance with certain of the principles of this invention by configuring an elongated tube, which is fabricated of convoluted fiber-containing sheet material in which the fibers extend predominantly longitudinally and the convolutions are bonded together with a hardenable bonding material, such that the tube has a generally flattened shape with at least one pair of opposed spaced parallel walls which are provided with longitudinally-extending grooves, beads, or indentations disposed parallel to the longitudinal axis of the tube to thereby provide enhanced support by reason of improved resistance to axially directed compressive loads and enhanced cushioning by reason of improved resistance to transversely directed forces.

In accordance with one preferred form of the invention, which is particularly adapted for use with the walls of a container due to its enhanced cushioning characteristics, the generally flattened tube is provided with two opposed parallel walls in each of which there is at least one longitudinally-extending groove, bead, or identation parallel to the axis of the tube, with the indentations in the opposed walls located relative to each other such that they are in substantial alignment. As a consequence, when the tube is subjected to transverse loads, the aligned longitudinal indentations in the two opposed parallel walls contact each other along their confronting internal surfaces, providing enhanced resistance to deflection, or bowing, that is, enhanced cushioning.

In addition to being useful as a cushioning member for the wall of a container, the foregoing two-sided embodiment of the invention is also useful as a core or reel for bolts of fabric which are horizontally disposed in vertical stacks.

In accordance with another preferred embodiment of the invention, which is particularly adapted for container corner reinforcing applications where cushioning is desired over a substantial area per unit length, the flattened tube is provided with two pairs of opposed parallel walls, with the pairs of walls extending generally perpendicular to each other to provide the tube with a generally right-angled cross section. In accordance with this embodiment, the opposed parallel walls of each pair have aligned parallel longitudinally extending grooves, indentations, or beads. Such a construction provides improved axial and cushioning support for the corner of a container.

An important advantage of the improved compressive and cushioning support tubes of this invention is that they do not excessively increase the amount of fiber-containing sheet material required per unit increase in resistance to axially directed compressive forces and transversely directed lateral forces. Moreover, the improved support tubes of this invention do not excessively project into the interior of a container with which they are used and thereby unnecessarily reduce the usable volume of the container.

These and other features, advantages, and objectives of the invention will become more readily apparent from a detailed description thereof taken in conjunction with the drawings in which.

Figure 1:
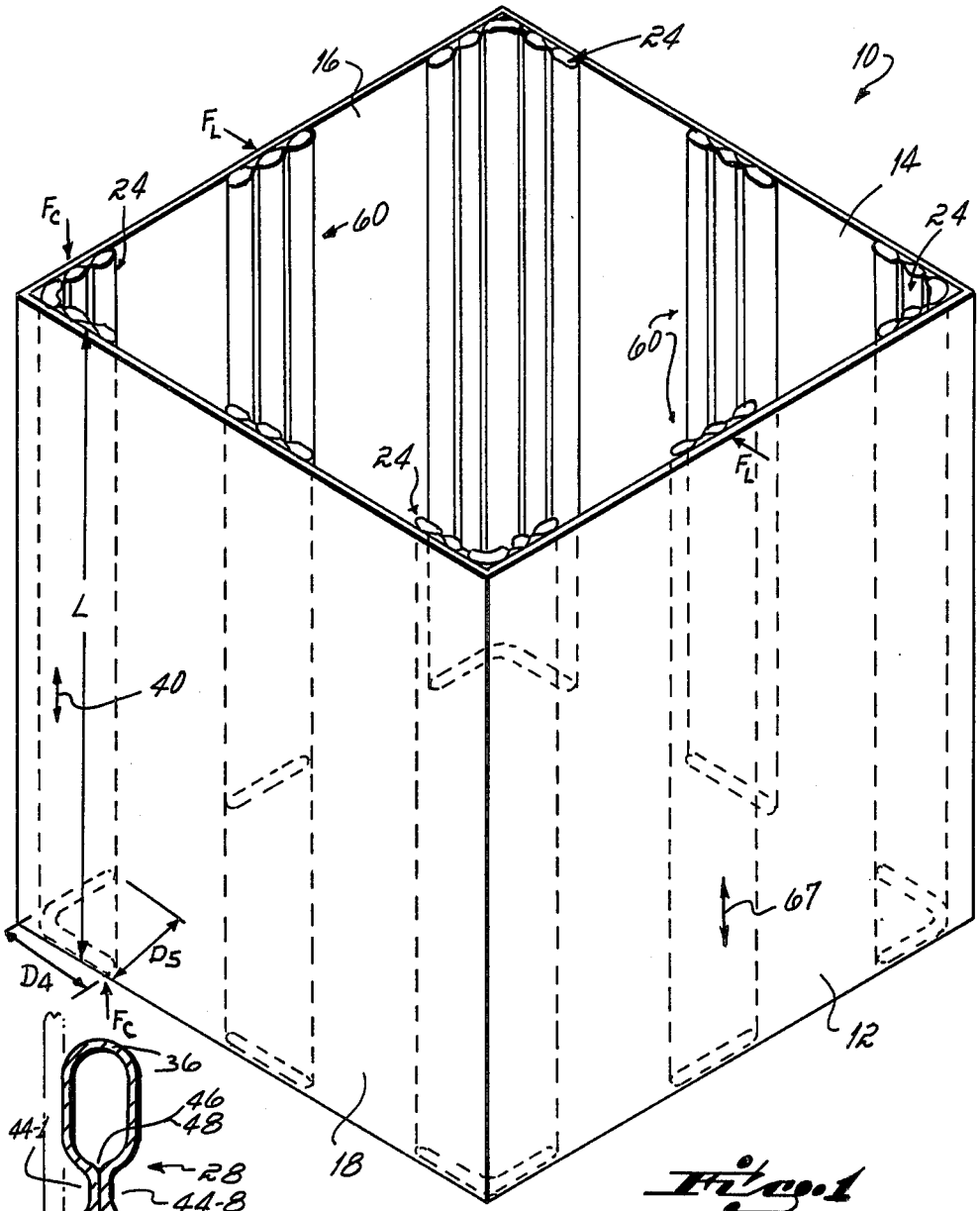
FIG. 1 is a perspective view of a container having a corner-reinforcing tube constructed in accordance with one embodiment of this invention located at each internal corner thereof, and a wall-reinforcing tube construed in accordance with a second embodiment of this invention disposed midway between the corners of the container.

To facilitate a complete understanding of the invention, the preferred embodiments thereof are shown, by way of example, as corner and wall reinforcements for a corrugated fiberboard container 10, as is apparent from FIG. 1. The container 10 includes four planar side walls 12, 14, 16, and 18, as well as a planar bottom and a planar top. The top may consist of flaps which are extensions of the upper portions of side walls 12, 14, 16, and 18. Similarly, the bottom may be in the form of flaps extending from the lower portions of the side walls 12, 14, 16, and 18. Since the container 10 is described only by way of illustration of one application for the reinforcing supports of this invention, and is otherwise totally conventional, further description thereof is unnecessary.

To strengthen the four corners of the container 10 formed by the intersecting side walls 12, 14, 16, and 18 a corner reinforcing support 24, constructed in accordance with one preferred embodiment of the invention, is disposed vertically at the interior of each corner of the container. The support 24 takes the form of an elongated flattened tube having a generally right-angle cross-section formed by a first pair 26 of opposed, spaced, planar, parallel walls 26*a* and 26*b* and a second pair 28 of opposed, spaced, planar, parallel walls 28*a* and 28*b*. The inner walls 26*b* and 28*b* are joined at inner corner 30, while the exterior walls 26*a* and 28*a* are joined at outer corner 32. The walls 26*a* and 26*b* are joined to each other at outer edge 34, while the walls 28*a* and 28*b* are joined to each other at outer edge 36. The inner corner section 30, the outer corner section 32, and the two outer edge sections 34 and 36, in combination with the inner walls 26*b* and 28*b* and the outer walls 26*a* and 28*a*, form an integral, unitary, one-piece elongated tubular structure having a generally right-angled cross-section as is more clearly apparent in FIG. 2.

The inner and outer corners 30 and 32, and the outer edge sections 34 and 36 are gently curved, that is, provided with a radius, which is conveniently proportioned in accordance with the particular dimensions of the support 24. For example, in a construction having an overall thickness $D_1$ of $\frac{3}{4}''$ and a tubular wall thickness $D_2$ of $\frac{1}{8}''$, a radius $R_1$ consistent with a spacing $D_3$ of $\frac{1}{4}''$ between the confronting interior surfaces 26*a*′ and 26*b*′ of the outer and inner walls 26*a* and 26*b* of the pair of walls 26. The radius $R_2$ and $R_3$ for the inner and outer corners 30 and 32 is also conveniently proportioned, as desired.

The overall dimensions of the support 24 are also selected as desired for the particular application. For example, the length L is selected to extend between the top 22 and the bottom 20 of the container 10, while the transverse dimensions $D_4$ and $D_5$ are selected depending upon the amount of cushioning and longitudinal compressive strength desired, and may, for example, each be 5″ if the reinforcing support 24 is used in containers for large appliances such as dishwashers, clothes dryers, refrigerators and the like. If desired the transverse dimensions $D_4$ and $D_5$ in a given support may be different. For example, the transverse dimension $D_4$ of one pair of opposed side walls 28 may be 3″ while the other transverse dimension $D_5$ for the other pair of walls 26 may be 5″.

The tubular corner reinforcing support 24 is constructed of convoluted fiber-containing sheet material, preferably Kraft paper, in which the fibers extend predominantly longitudinally, that is, in the vertical direction shown by the double headed arrow 40. The convolutions are bonded together with a hardenable bonding material. The sheet material may be wound on a mandrel, after having the bonding material applied thereto, in accordance with the teachings of U.S. Pat. No. 3,648,920, the entire disclosure of which is specifically incorporated herein by reference.

The mandrel on which the sheet material is wound during the tubefabrication process may be in the form of an elongated bar of generally rectangular or elliptical cross-section having a nominal length slightly in excess of the length L of the support 24 and a width slightly less than the sum of the nominal transverse dimensions $D_4$ and $D_5$ of the support 24. The thickness of the winding mandrel would be selected equal to the spacing $D_3$ between the confronting interior surfaces 26*a*′ and 26*b*′ of the walls 26*a* and 26*b*. After the winding mandrel has been wound with the necessary number of convolutions, for example, twenty, and before the bonding agent has hardened, the tubular support is removed from the winding mandrel by sliding it longitudinally off the mandrel. The tube is then formed or shaped to provide the right-angled cross-section shown in FIGS. 1 and 2. The right-angled cross-section can be obtained by placing the tube on an elongated forming mandrel having a right-angled cross-section and the so-mounted tube compressed between opposed elongated pressing members having right-angle cross-sections complementary to that of the forming mandrel to establish the inner and outer corners 30 and 32. The tube is pressed on the forming mandrel with the pressing members in the shape conforming to the desired right-angled cross-section until the hardenable bonding material adhesively joining adjacent convolutions of the tube has hardened.

Extending longitudinally in each of the walls 26*a* and 26*b*, 28*a* and 28*b*, of the support 24 are identically configured indentations, beads, or grooves 44 which extend vertically the entire length L of the support. The confronting indentations, grooves or beads 44-1 and 44-8 in opposed walls 28*a* and 28*b* are in alignment with each other, as are the other confronting pairs of indentations 44-2 and 44-7, 44-3 and 44-6, and 44-4 and 44-5. Preferably, the inner confronting surfaces 26*a*′ and 26*b*′ and 28*a*′ and 28*b*′ of the walls in the region of the indentations are in contact with each other, that is, longitudinal surface region 46 is in contact with longitudinal surface region 48 as shown in FIG. 2.

Figure 2:
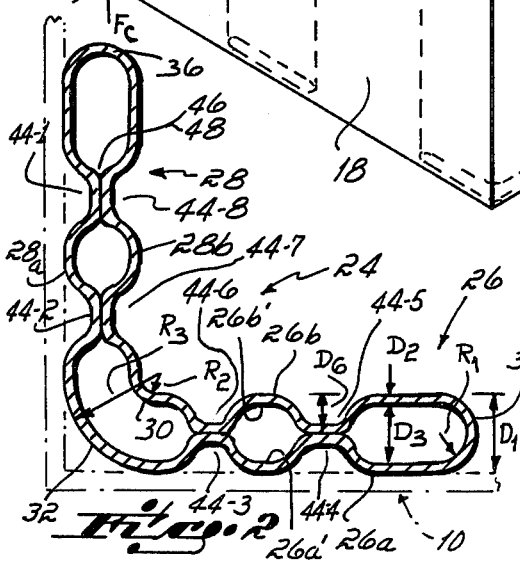
FIG. 2 is a cross-sectional view of the corner-reinforcing embodiment of this invention.

The overall depth $D_6$ of the indentations is selected in proportion to the other dimensions of the support 24 and in the illustration of FIGS. 1 and 2 is selected to be $\frac{3}{8}''$. As noted, the confronting inner surfaces 46 and 48 of oppositely disposed aligned indentations are in physical contact with each other, but preferably are not bonded or adhered to each other with an adhesive, cement or other bonding agent. The nominal width $D_5$ of the indentations 44 are also selected in proportion to the other dimensions of the support, and in the illustrative support of FIGS. 1 and 2 is selected to be approximately $\frac{1}{2}''$.

The indentations 44 are formed in the tube 4, when the tube is on the forming mandrel and being pressed between the complementary shaped elongated pressing members to provide the desired right-angle cross-section, by the cooperative interaction of male projections on the surface of the elongated pressing members and female indentations in the surface of the forming mandrel, which projections and indentations correspond in location and shape to the desired configuration of the indentations 44 in the support 24.

By reason of the indentations 44 provided in the corner support 24 the compressive strength in the axial or longitudinal direction of the support is substantially increased over a similar support not provided with the indentations, thereby enhancing the stacking strength of the container, that is, the strength of the container in a vertical direction when subjected to compressive forces in the direction of arrows $F_c$, $F_c$ shown in FIG. 1. The support 24 also has enhanced cushioning strength when subjected to lateral or transversely directed forces shown by arrows $F_L$, $F_L$ in FIGS. 1 and 2. Such enhanced cushioning strength protects the structural integrity of the container and prevents damage to the contents when the container is subjected to lateral or transverse forces in a horizontal plane.

The number of strengthening and cushioning indentations provided in a support, such as support 24, will depend upon the lateral dimensions $D_4$ and $D_5$ of the support and the amount of additional strength desired. The strength of the support, both axially and transversely, is increased as the number of longitudinal indentations, beads or grooves, is increased to some maximum number which can be accommodated by the transverse dimensions $D_4$ and $D_5$ of the support. As the dimensions $D_4$ and $D_5$ increase, the maximum number of indentations 44 which can be provided, and hence the maximum strength increases. Of course, less than the maximum number of longitudinal indentations for a support of a given size may be utilized if less than maximum additional strength is satisfactory for the particular application.

Figure 3:
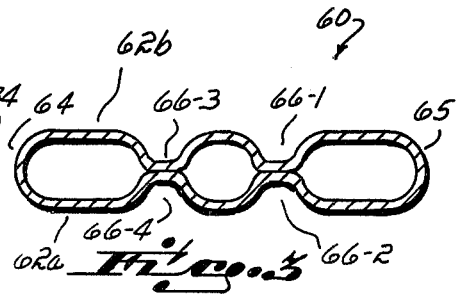
FIG. 3 is a cross-sectional view of the wall-reinforcing embodiment of this invention which also finds utility as a fabric bolt core.

In accordance with a further embodiment which is depicted in FIGS. 1 and 3, a reinforcing support 60 is provided having a single pair of spaced parallel sides 62*a* and 62*b* which are joined by longitudinally extending edge sections 64 and 65 to form a single integral generally flattened tube. The dimensions of the support 60 are selected and proportioned, as desired, in a manner similar to that discussed in connection with the support 24. The support 60, like the support 24, is provided with longitudinally extending grooves, beads or indentations 66 disposed parallel to the longitudinal axis of the support. Indentation 66-1 and 66-2 are aligned, as are indentations 66-3 and 66-4. The interior confronting surfaces of the support wall 62*a* and 62*b* in the region of the indentations 66 are in contact with each other, although preferably not adhered or bonded to each other. The number of aligned pairs of indentations 66 which are provided in a support 60 depends upon the overall width of the support measured between the longitudinal edges 64 and 65 as well as the degree of additional strength it is desired to impart to the tubular support by virtue of inclusion of the indentations. Both the resistance of the support 60 to compressive forces in a longitudinal, or axial, direction, as well as the resistance of the support to lateral, or transverse, forces, increases as the number of indentations 66 increases.

The support 60, like the support 24, is fabricated of convoluted fiber-containing sheet material, preferably Kraft paper, in which the fibers extend predominantly longitudinally in the direction of double headed arrow 67 and are bonded together with a hardenable bonding material. Fabrication of the tubular support 60 is similar to that for the rectangular cross-section support 24, except that after wrapping the convolutions of the tubular support on an elongated elliptical or bar-shaped wrapping mandrel having a generally flattened cross-section, the flattened tube is placed on an elongated forming mandrel of generally flat cross-section provided with indentations in the surface thereof and pressed between elongated pressing members having surface projections thereon which cooperate with the forming mandrel surface indentations to form the indentations 66 in the tube 60.

The support 60, when used to strengthen a container 10, is preferably located adjacent the interior side walls 12, 14, 16 and 18 at locations other than at the corners. If only a single support 60 is used in conjunction with each side of the container 10, the support is preferably located midway between the corners, as shown in FIG. 1. If more than one support 60 is used in conjunction with each side of the container 10, the supports are preferably spaced to provide equal distances between them as well as between the support 60 and adjacent right-angle supports 24 which may be provided at the corner. Additionally, the supports 60 may be provided on the interior of the bottom of the container and/or on the interior of the container top.

The support 60, in addition to providing reinforcement for a container, such as container 10 shown in FIG. 1, can also be used as a form or core for wrapping sheet material, such as fabric. In such applications the indentations or beads 66 prevent the support 60 from collapsing internally when bolts of fabric or the like wrapped sheet material are horizontally disposed in a vertical stack one on top of the other.

While the invention has been described in connection with use thereof for reinforcing containers and/or as cores for bolts of fabric or the like, the utility of the invention is not so limited. For example, the support 60 could be used as a bed slat to support a mattress or in any other application where substantial strength is required in longitudinal and transverse directions and/or substantial cushioning is needed.

In the preferred embodiments described above, longitudinal indentations are provided in each wall of the support, and indentations in opposed walls are aligned. However, it is possible to provide such indentations in one or more of the walls, but not in all the walls, if less than maximum resistance to compressive and lateral forces is desired. Similarly, it is also possible to locate indentations in opposed walls in nonalignment. Finally, instead of providing a pair of aligned indentations in opposite walls which contact each other, it is possible to provide nonaligned indentations of greater depth in opposed walls which extend entirely across the space between the walls and into contact with the inner surface of the opposite wall.

What is claimed is:

1. A packaging system for a product such as an appliance or the like having four rectangularly arranged vertical corner edges, comprising:

a rectangular container sleeve adapted to surround a rectangular product, said sleeve being dimensioned relative to the product to provide a clearance space at each corner thereof between nested vertical corner edges of said sleeve and a rectangular product located within said sleeve, said container having a top and a bottom, and a corner post in each said clearance space, each said corner post including a unitary one-piece convolutely wound paper tube having its surface treated with a hardenable material and its fibers disposed longitudinally, each said tube having an unsealed and unpressurized interior and including a generally flattened section shaped to provide a substantially right angular cross-section defined by generally planar spaced-apart, substantially parallel outer and inner walls shaped at substantially right angles along vertical outer and inner corners, respectively, to engage the associated inner vertical corner edge of said sleeve and the associated external vertical corner edge of a product, respectively, each said tube having a first plurality of longitudinally-directed indentations along the length of at least one of said inner and outer walls on each side of its respectively associated corner edge, said plural indentations in said one wall extending substantially across said flattened tube section to said other wall, but being structurally unconnected relative thereto throughout a substantial portion of their length, for dividing said flattened tube section into at least three longitudinally-directed tubular subsections, said three tubular subsections including (a) a central tubular subsection located in the general region between said inner and outer vertical corners to provide a protective buffer for the vertical corner edge of a product located in said container sleeve, and (b) a pair of outer tubular subsections disposed on opposite sides of said central subsection defined by spaced-apart outer and inner wall sections, said indentations separating said central subsection from said outer subsections and having inner surfaces proximate said other wall opposite thereto for contacting the inner surface of said other wall when said corner post begins to buckle under compressive longitudinally-directed forces and/or transversely-directed forces applied thereto, each said tubular subsection being closed in horizontal cross-section throughout substantially its entire cross-section.

2. The system of claim 1 wherein the other wall of each said tube includes a second plurality of longitudinally-directed indentations, each having an inner surface proximate and adapted to contact the inner surface of said one wall when said corner post begins to buckle under compressive longitudinal and/or transverse forces applied thereto, the inner surface of each of said second plurality of indentations being structurally unconnected, throughout a substantial portion of its length, to the confronting inner surface of said one wall.

3. The system of claim 2 wherein said first and second plurality of indentations are aligned with each other.

4. The packaging system of claim 1 wherein said central tubular subsection has a substantially right-angled cross-section defined by spaced-apart parallel, planar, right-angled outer and inner wall sections to straddle the vertical corner edge of a product located in said container sleeve.

5. A corner post adapted to be snugly sandwiched in a clearance space between nested vertical corner edges of a rectangular container sleeve and a rectangular product located within the sleeve and adapted to be positioned between a container top cover and a container bottom, said corner post comprising:

a unitary one-piece convolutely wound paper tube having its surface treated with a hardenable material and its fibers disposed longitudinally, said tube having an unsealed and unpressurized interior and including a generally flattened section formed to provide a substantially right angular cross-section defined by generally planar spaced-apart, substantially parallel outer and inner walls shaped at substantially right angles along vertical outer and inner corners, respectively, to engage the associated inner vertical corner edge of said sleeve and the associated external vertical corner edge of a product, respectively, said tube having a first plurality of longitudinally-directed indentations along the length of at least one of said inner and outer walls on each side of its respectively associated corner, said plural indentations in said one wall extending substantially across said flattened tube section to said other wall, but being structurally unconnected relative thereto throughout a substantial portion of their length, for dividing said flattened tube section into at least three longitudinally-directed tubular subsections, said three tubular subsections including (a) a central tubular subsection located between said inner and outer vertical corners to provide a protective buffer for the vertical corner edge of a product located in said container sleeve and (b) a pair of outer tubular subsections disposed on opposite sides of said central subsection defined by spaced-apart outer and inner wall sections, said identations separating said central subsection from said outer subsections and having inner surfaces proximate said other wall opposite thereto for contacting the inner surface of said other wall when said corner post begins to buckle under compressive longitudinally-directed forces and/or transversely-directed forces applied thereto, each said tubular subsection being closed in horizontal cross-section throughout substantially its entire cross-section.

6. The corner post of claim 5 wherein said central tubular subsection has a substantially right-angled cross-section defined by spaced-apart parallel, planar, right-angled outer and inner wall sections to straddle the vertical corner edge of a product located in said container sleeve.

* * * * *